US010450770B2

(12) United States Patent
Klein

(10) Patent No.: US 10,450,770 B2
(45) Date of Patent: Oct. 22, 2019

(54) MULTI LAYERED PROTECTION SYSTEM

(71) Applicant: Amos Klein, Haifa (IL)

(72) Inventor: Amos Klein, Haifa (IL)

( * ) Notice: Subject to any disclaimer, the term of this patent is extended or adjusted under 35 U.S.C. 154(b) by 0 days.

(21) Appl. No.: 15/739,919

(22) PCT Filed: Jun. 29, 2016

(86) PCT No.: PCT/IL2016/050698
§ 371 (c)(1),
(2) Date: Dec. 26, 2017

(87) PCT Pub. No.: WO2017/002119
PCT Pub. Date: Jan. 5, 2017

(65) Prior Publication Data

US 2018/0187444 A1 Jul. 5, 2018

(30) Foreign Application Priority Data

Jun. 29, 2015 (IL) ..... 239683

(51) Int. Cl.
*E04H 9/10* (2006.01)
*E04B 1/348* (2006.01)
(Continued)

(52) U.S. Cl.
CPC ..... *E04H 9/10* (2013.01); *E04B 1/3445* (2013.01); *E04B 1/3483* (2013.01); *E04B 1/34861* (2013.01); *E04B 1/943* (2013.01); *F41H 5/24* (2013.01); *E04B 2001/34389* (2013.01); *E04H 2001/1283* (2013.01)

(58) Field of Classification Search
CPC ..... E04H 9/10; E04B 1/3445; E04B 1/3483; E04B 1/943
See application file for complete search history.

(56) References Cited

U.S. PATENT DOCUMENTS 4,557,099 A * 12/1985 Johnson ..... E04B 1/3445 52/125.1
4,722,155 A * 2/1988 Ericsson ..... E04H 9/10 52/127.4
(Continued)

FOREIGN PATENT DOCUMENTS

DE 19835955 A1 2/2000
WO 9814670 A1 4/1998
(Continued)

*Primary Examiner* — Paola Agudelo
(74) *Attorney, Agent, or Firm* — William Dippert; Laurence Greenberg; Werner Stemer

(57) ABSTRACT

A multi layered protection system is provided that comprises a plurality of box-shaped structural elements, each having a frame made of beams, wherein the frame is bounded by a floor at a lower side, a roof at an upper side, and four sides, and wherein at least two box-shaped structural elements of the plurality are positioned adjacently to one another so as to form a modular protection structure having outer sides. The system further comprises a plurality of walls configured to bound the outer sides and at least one layer of protective wall configured to be mounted adjacent to said plurality of walls and the roof. A method of erecting the modular multi layered protection system in a site is also provided.

14 Claims, 11 Drawing Sheets

(51) Int. Cl.

| | |
|---|---|
| ***F41H 5/24*** | (2006.01) |
| ***E04B 1/344*** | (2006.01) |
| ***E04B 1/94*** | (2006.01) |
| *E04H 1/12* | (2006.01) |
| *E04B 1/343* | (2006.01) |

(56) References Cited

U.S. PATENT DOCUMENTS 4,989,379 A * 2/1991 Suzuki ..... E04B 1/3442 52/66
5,706,614 A * 1/1998 Wiley, Jr. ..... E04B 1/3483 52/537
5,950,373 A 9/1999 von Hoff et al.
8,132,493 B1 * 3/2012 Adams ..... F41H 5/0421 89/36.02
8,484,929 B1 * 7/2013 Begdouri ..... E02D 29/045 52/745.03
8,596,018 B2 12/2013 Dagher et al.
8,770,422 B2 * 7/2014 Cantin ..... E04B 1/3442 206/386
2004/0206015 A1 10/2004 Greenboim
2005/0223651 A1 10/2005 Lange-Kornbak et al.
2009/0090236 A1 * 4/2009 Misencik ..... E04H 9/10 89/36.02
2011/0197746 A1 8/2011 Melrose et al.
2012/0006369 A1 1/2012 Cantin et al.
2012/0151851 A1 * 6/2012 Cantin ..... E04B 1/34305 52/79.5
2013/0233164 A1 9/2013 Kestermont
2014/0076138 A1 * 3/2014 Owen ..... F41H 5/0421 89/36.02
2017/0130474 A1 * 5/2017 Rebollar Buldain ... E04H 1/005
2017/0198489 A1 * 7/2017 Klein ..... E04H 9/04

FOREIGN PATENT DOCUMENTS

WO 2008150174 A1 12/2008
WO 2012101598 A2 8/2012
WO WO-2016009427 A1 * 1/2016 ..... E04H 9/04

* cited by examiner

MULTI LAYERED PROTECTION SYSTEM

CROSS-REFERENCE TO RELATED APPLICATIONS

This application is a National Phase filing under 35 U.S.C. § 371 of International Patent Application No. PCT/IL2016/050698, filed Jun. 29, 2016, which is based upon and claims the benefit of the priority date of Israeli Patent Application No. 6239683, filed Jun. 29, 2015, each of which is incorporated herein by reference.

FIELD

The present invention relates to the field of human shelters erected in armed conflict zones, and more particularly to the field of shelters that can be easily erected on site in conflict zones and contain a multi layered protection.

BACKGROUND

In many battle fields, when it is necessary to protect the troops, trenches are being dag, or protective walls are being erected. For many years, the protective walls were made of sacks filled with local earth or sand. This system is very cheap and easy to implement since it can be carried out by relatively small sacks that, when filled, can be easily carried out by a person. Thus, if enough sacks are piled, they enable enough protection against light and medium flat-trajectory weapons like rifles and machine guns.

In many armed conflict zones around the world, there is a need to protect the military forces from being injured by steep-trajectory weapons, like rockets, missiles, and mortars. In this case, piling of sacks filled with earth or sand is not satisfactory since there is a need to supply enough protection from the upper side as well.

A large variety of structures and solutions are used, such as shelters, bunkers or other types of constructed buildings. Despite the fact that these structures provide the necessary protection, they suffer from various disadvantages; they are very expensive, require a large erection time, and cannot be re-used in another site.

In order to provide a sheltering structure that protects against steeptrajectory weapons, various solutions are known in the market. A structure known as "Mivtsar Yehuda" (namely, Yehuda Fortress) by Yehuda Fences Ltd. (www.yfence.co.il), is a military fortification structure that is designed for fast erection for protection of a maritime container in the size of 600×250×250 cm. The "Mivtsar Yehuda" consists of elements that are constructed of a galvanized steel net envelope, and an inner sheet made of a UV protected geo-textile cloth. When these elements are filled with earth, they form a bulged box-like shape. Placing the filled elements one adjacent the other enables to erect a protective structure around the container. However, a main disadvantage of this structure is that the basic elements cannot be used directly for building a protective roof. Thus, in order to enable placing of the earth-filled elements as a protective roof, first, a special steel structural frame has to be erected, whether it is a one-piece structure, or, a modular structure made of steel beams, rods and plates that are modularly connected to each other in order to form a strong structure that can withstand a high load thereon without collapsing. Second, the steel structural frame is placed on the previously erected structure of filled elements, and then, third, new filled elements are placed on the structural frame to be used as a protective roof. Since the structural frame has a relatively high height in order to withstand the heavy loads apply thereon, it exposes the protected item, in this case, the container, to medium inclination trajectory exploding items. Thus, it is necessary to form the structural frame large enough, i.e., with a large overlapping relative to the vertical walls made by the filled elements, in order to assure that the container is well protected from the top side. Furthermore, if an explosive charge falls and explodes adjacent the entrance to the protected area, there is a direct line of explosion towards the protected area. This problem could be avoided just with addition of a substantial number of filled elements.

HESCO Bastion Ltd. (www.hesco.com), based in the UK, manufactures a force protection product known as a Concertainer unit. The Concertainer unit is a multi-cellular wall system manufactured from welded Zinc-Alu coated steel wire mesh and joined with vertical, helical coil joints. The units are lined with heavy-duty non-woven polypropylene geotextile. The concertainer units use locally available fill material to rapidly construct defensive barriers and other structures with minimal manpower and resources. The concertainer units can be extended and joined together to provide effective and economical structures according to threat needs and level of protection required. A rapid in-theatre deployment utilizes a specially designed and engineered container to provide a significant increase in the quantity of concertainer units that can be transported in a 20 ft ISO container footprint. HESCO have developed the HLBR (HESCO lightweight bunker roof), a rapid and easily erectable lightweight roof specifically designed to provide protection against IDF weapons. The roof can be built on almost any walls capable of taking the load that the roof will impose upon it. Again, this roof is a specially built item in order to withstand the load applied thereon, and it cannot be made from the same units that form the walls.

An HESCO bunker set has been developed to utilize 40 ft and 20 ft ISO containers. Walls are constructed using specifically adapted Mil 1 Concertainer units to give a protective wall thickness of in excess of 1 m. The roof design provides 0.6 m of overhead cover. Material bunkers provide access from one end of the bunker, while personnel bunkers provide access from both ends. Again, in this design, the roof cannot utilize the same units forming the walls.

SUMMARY

It is an object to provide a multi layered protection system that significantly reduces or overcomes the aforementioned disadvantages.

It is a further object to provide a modular protection system that is transportable.

It is still a further object to provide a modular protection structure that is easily and quickly erected and disassembled.

It is still yet a further object to provide a modular protection system that is easy to operate.

It is also a further object to provide a modular protection system that provides multi layered protection.

It is another object to provide a multi layered protection system that may be entirely used a multitude of times.

In accordance with the presented embodiments, there is provided a multi layered protection system comprising:

a plurality of box-shaped structural elements, each having a frame made of beams, wherein the frame is bounded by a floor at a lower side, a roof at an upper side, and four sides, and wherein at least two box-shaped structural elements of the plurality are positioned adjacently to one another so as to form a modular protection structure having outer sides;

a plurality of walls configured to bound said outer sides;

at least one layer of protective wall configured to be mounted adjacent to said plurality of walls and the roof.

In accordance with another embodiment, said at least one layer of protective wall is a protective panel that covers the wall or the roof.

In accordance with another embodiment, side beams of the beams are provided with oppositely directed vertical rails configured to receive the protective panel.

In accordance with another embodiment, said at least one protective wall comprises a plurality of protective boards mounted adjacently to cover the wall.

In accordance with another embodiment, side beams of the beams and at least a portion of the plurality of walls are provided with rings for receiving a corresponding pin of the protective board.

In accordance with another embodiment, pair of rails configured to receive a protective panel are parallel to each other.

In accordance with another embodiment, pair of rails configured to receive a protective panel are converging in a downward direction.

In accordance with another embodiment, the structural elements are formed from an ISO container.

In accordance with another embodiment, the structural elements are formed from a 20 ft ISO container.

In accordance with another embodiment, the structural elements of the modular protection structure are secured to each other.

In accordance with another embodiment, protective wall is distanced from its adjacent wall by a separation buffer.

In accordance with another embodiment, in the modular protection structure, each structural element abuts an adjacent structural element.

In accordance with another embodiment, the multi layered protection system can withstand blasts of a 120 mm mortar shell.

In accordance with another embodiment, the protective panel is formed from a solid steel plate.

In accordance with another embodiment, the protective boards are made from a solid steel plate.

In accordance with another embodiment, each of the protective boards is provided on an inner side with pins adapted to suspend on corresponding rings on the frame and the walls, and from the outer side with handles configured to allow a person to suspend the protective board onto the walls and rings configured to receive corresponding pins of another layer of protective boards.

In accordance with another embodiment, the protective walls are formed from active protection layers.

In accordance with another embodiment, the structural element can be expandable structural element that can expand from both opposite sides.

In accordance with another embodiment, the roof is provided with lifting ears configured to allow lifting the structural element.

In accordance with another embodiment, said protective panel is provided with lifting ears configured to allow lifting the protective panel in a vertical or horizontal state.

In accordance with another embodiment, one of the plurality of walls is provided with a door and wherein the adjacent protective wall correspond to have a corresponding opening.

In accordance with another aspect, a method of erecting a multi layered protection system in an erection site is provided that comprises:

delivering to the erection site at least one box-shaped structural element having a frame made of beams, wherein said frame is bounded by a floor at a lower side, a roof at an upper side, and four sides;

positioning the structural elements one by the other to form a protective structure having outer sides;

closing the outer sides with walls;

adjacently positioning at least one layer of protective wall on the outer walls and the roof.

In accordance with another embodiment, closing the outer sides with walls is performed before the delivering according to an erection plan.

In accordance with another embodiment, the structural element is an expandable element that is expanded to about 3 times the volume of the structural element.

In accordance with another embodiment, said adjacently positioning the protective wall comprising inserting a protective panel through corresponding rails on the beams of the structural element so as to cover an entire wall.

In accordance with another embodiment, said adjacently positioning the protective wall comprising suspending at least one layer of a plurality of protective boards on the outer walls of the structural element.

BRIEF DESCRIPTION OF THE DRAWINGS

For a better understanding of the present invention and to show how the same may be carried out in practice, reference will now be made to the accompanying drawings, in which.

DESCRIPTION OF PREFERRED EMBODIMENTS

It is depicted a multi layered protection system comprising:

a plurality of box-shaped structural elements, each having a frame made of beams, wherein the frame is bounded by a floor at a lower side, a roof at an upper side, and four sides, and wherein at least two box-shaped structural elements of the plurality are positioned adjacently to one another so as to form a modular protection structure having outer sides;

a plurality of walls configured to bound said outer sides;

at least one layer of protective wall configured to be mounted adjacent to said plurality of walls and the roof.

Figure 1:
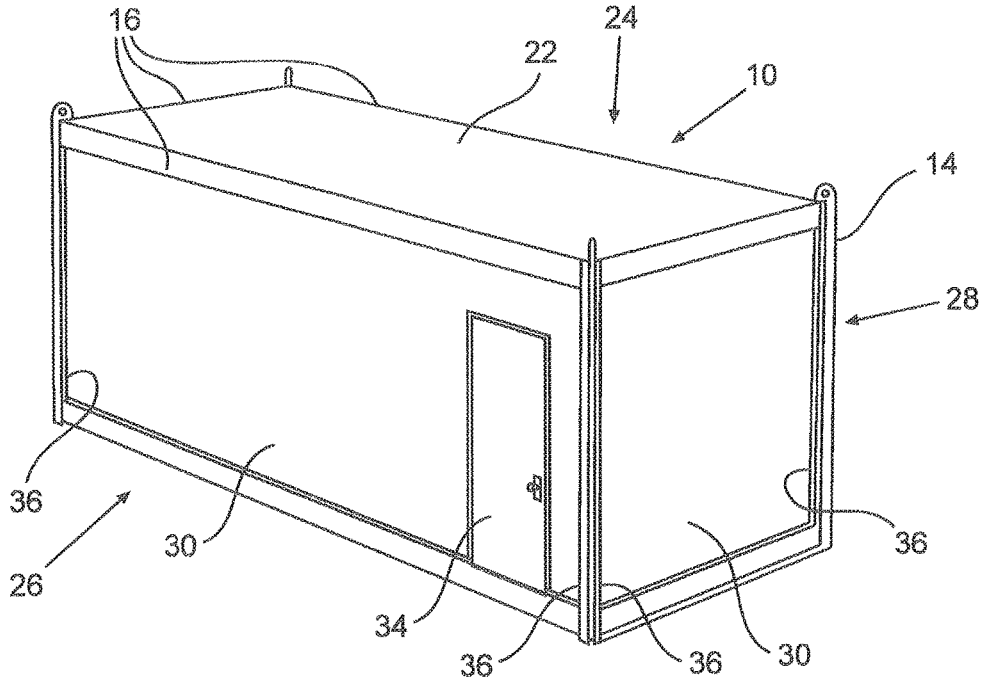
FIG. 1 is a perspective view of a first structural element of a multilayered protection system according to an exemplary embodiment.
Figure 2:
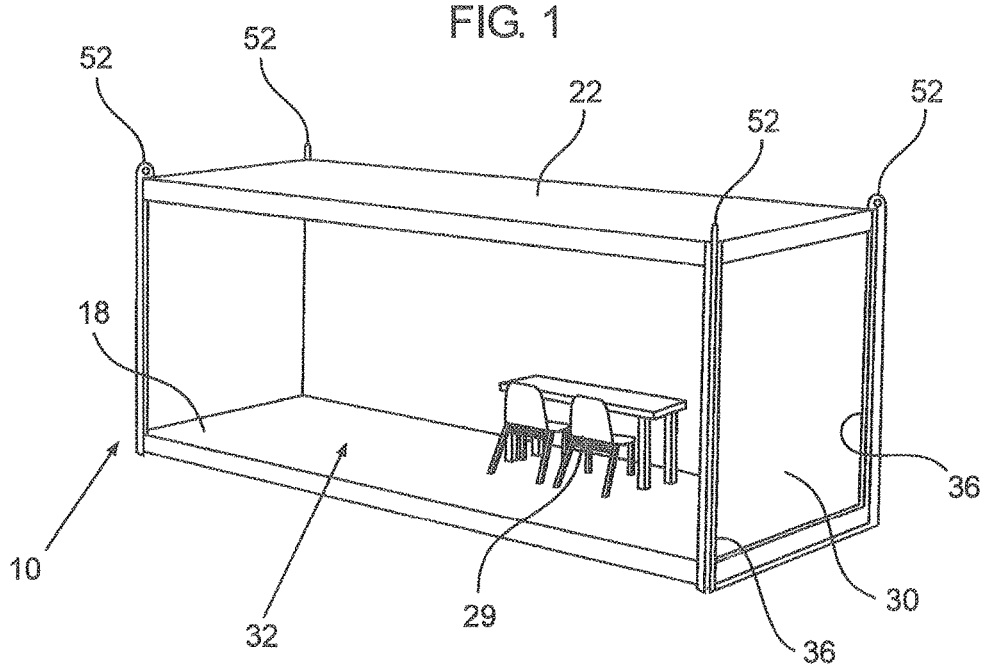
FIG. 2 is a perspective view of a second structural element of a multilayered protection system according to the exemplary embodiment.
Figure 3:
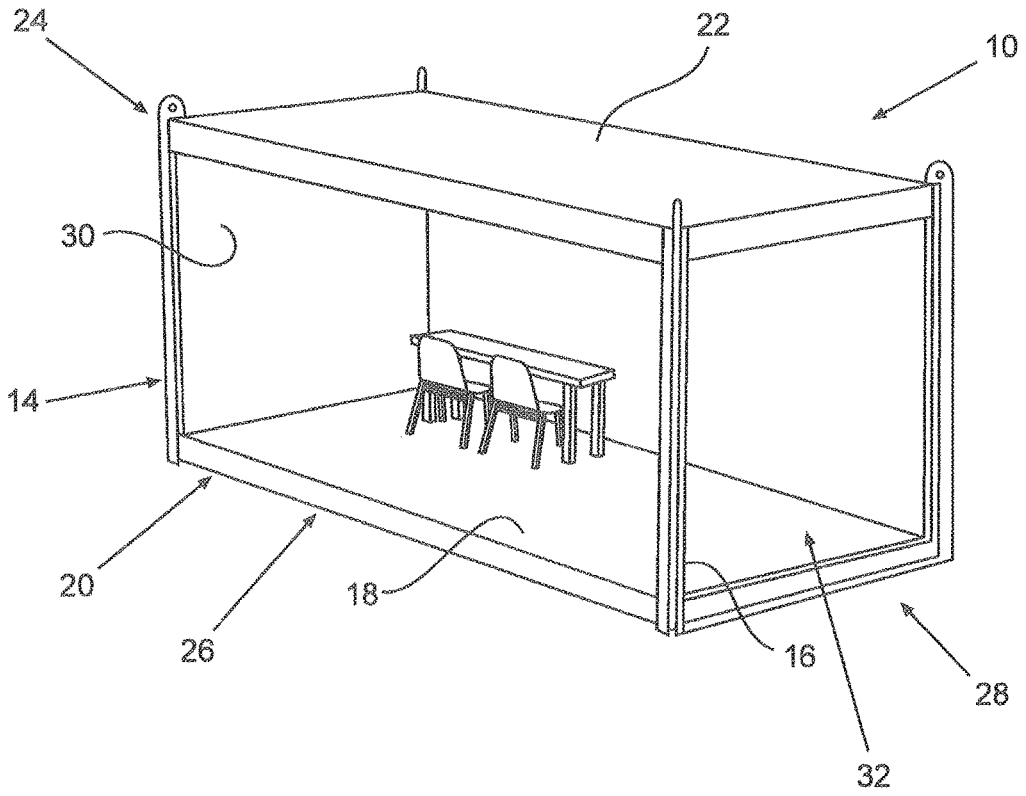
FIG. 3 is a perspective view of a third structural element of a multilayered protection system according to an exemplary embodiment.

Attention is first drawn to FIGS. 1 to 3 that show three embodiments of structural elements 10 that may act independently or form parts of a multi layered protection system according to an exemplary embodiment. Each of the structural elements 10 has a box shape and comprises a frame 14 made of beams 16. Each box shape has six sides: a lower side 20 of the structural element 10 onto which a floor 18 may extend between the appropriate beams 16; an upper side 24 of the structural element 10 onto which a roof 22 may extend between the appropriate beams 16; two substantially oppositely directed long faces 26, and, two substantially oppositely directed short faces 28 extending between the long faces 26. Each of the long faces 26 or the short faces 28 may comprise a closed wall 30 that extends to the frame 14 between the beams, or, may be an open face. It should be noted that directional terms appearing throughout the specification and claims, e.g. "forward", "rear", "upper", "lower" etc., are used as terms of convenience to distinguish the location of various surfaces relative to each other. These terms are defined with reference to the figures; however, they are used for illustrative purposes only, and are not intended to limit the scope of the appended claims.

Each structural element 10 can be independently produced to be appropriate for being a part of a multi layered protection system 12. However, it is beneficial to use standard ISO containers since they are relatively cheap, handy, and their frame has been widely approved as being strong, rigid, and durable.

Typically, for most uses, the multi layered protection system 12 utilized 20 ft ISO containers to form each structural element 10. However, according to some embodiments, 40 ft ISO containers may be effectively used as well.

Thus, FIG. 1 shows a structural element 10 having walls 30 on the long faces 26 facing forward and backwards, and a wall 30 on each of the short faces 28. Furthermore, as can be seen, the front wall 30 comprises a door 34 for enabling people to enter into the erected multi layered protection system 12 as will be further described.

FIG. 2 shows a structural element 10 having an open face 32 on the frontal long face 26 and a wall 30 on the two short faces 28.

FIG. 3 shows a structural element 10 having one pair of adjacent long face 26 and short face 28 being open face 32, and, the other pair of adjacent long face 26 and short face 28 having walls 30.

In FIG. 2 as well as in FIG. 3, it can be seen that furniture 29, in this case a table and two chairs, can be incorporated within the structural element 10 so as to provide convenience in preparing the shelter.

The side beams 16 of the frame 14 are provided with vertically directed opposite rails 36. The rails 36 are generally parallel to each other and face each other so as to receive a board as will be explained hereinafter. Optionally, according to some embodiments, the rails 36 are slightly converging toward each other in a downward direction.

Lifting ears 52 are provided on the upper portion of the frame 14, directed upwardly so as to allow carrying the structural element using a crane, as an example.

Figure 4:
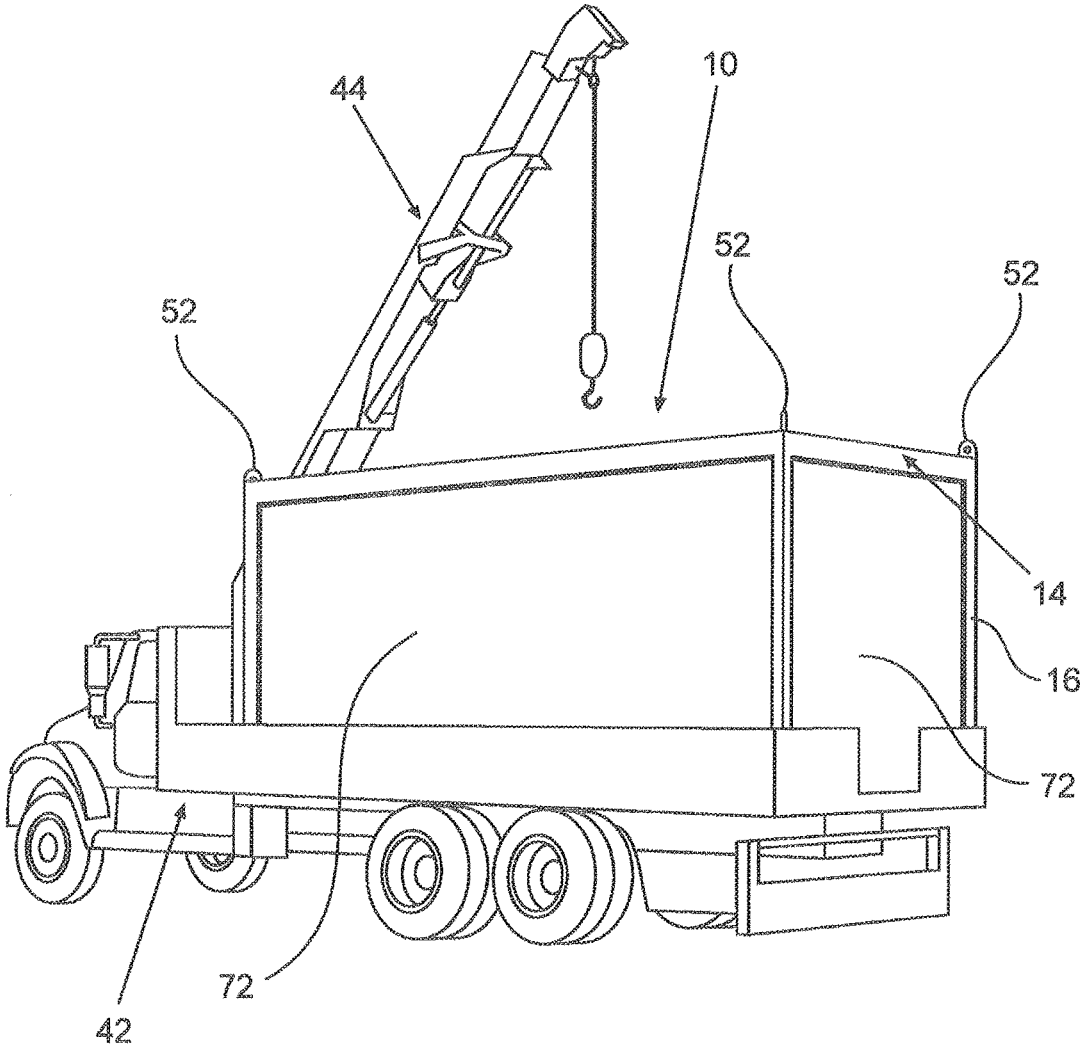
FIG. 4 is a perspective view of a structural element according to an exemplary embodiment during transportation by a truck.
Figure 7:
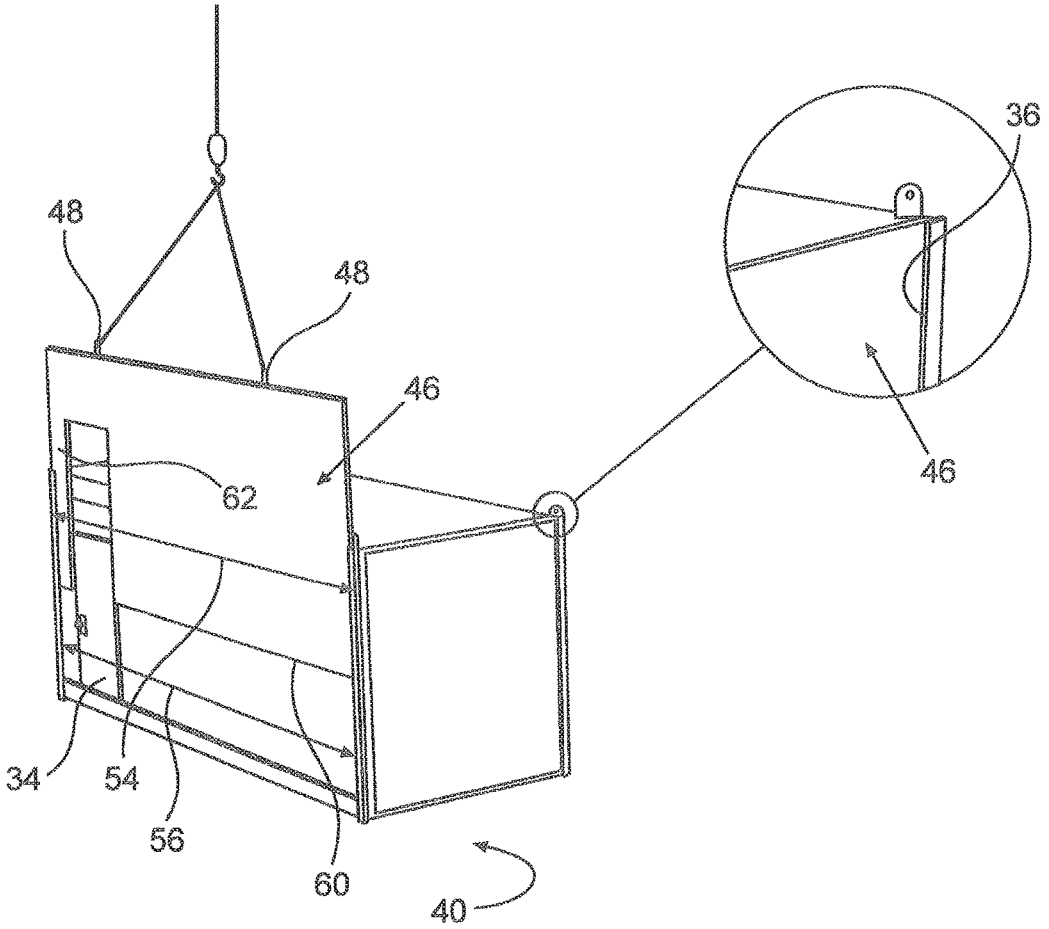
FIG. 7 is a perspective view of an assembling process of protective panels on side walls of structural elements according to an exemplary embodiment that are positioned in place.

Each of the structural elements 10 is transported to an erection site 40 (as shown in FIG. 7) by a standard truck for being unloaded by a local forklift or crane. However, typically, as seen in FIG. 4, the structural elements 10 are each transported by a truck 42 having its own crane 44 for unloading the structural element 10 at the erection site. The structural elements can be transported fully prepared to be placed in the erection site, ready for immediate use, or they can be transported "naked" (only frames) or partially "naked" and prepared on site. This means that the walls are being transported independently and installed onto the frame on site. In this case, during transportation of the structural element, open sides thereof may be covered, if desired, with a temporary cover 72 made of canvas, fabric, or the like, that is rolled, folded, or removed during the installation of the structural elements.

As mentioned herein before, the vertical beams of the structural element's frame are provided with rails 36 adapted to receive protective panels for increasing the ballistic resistance of the walls of the multi layered protective system. The protective panels are substantially at the same size of the sides of the structural elements so that they cover the whole side and may be formed from at least one layer of steel or other protective material. Thus, in many cases, the protective panels are formed from a 30 mm steel plate. However, according to preferred embodiments of the present invention, the protective panels are formed from several layers of protection, either passive or active protection, according to protective panels that are known in the art.

Optionally, instead of rails, the frame and the walls can be provided with elements adapted to secure a plurality of smaller protective boards that can be installed onto the sides of the structural elements in layers, as will be shown herein after.

Figure 5:
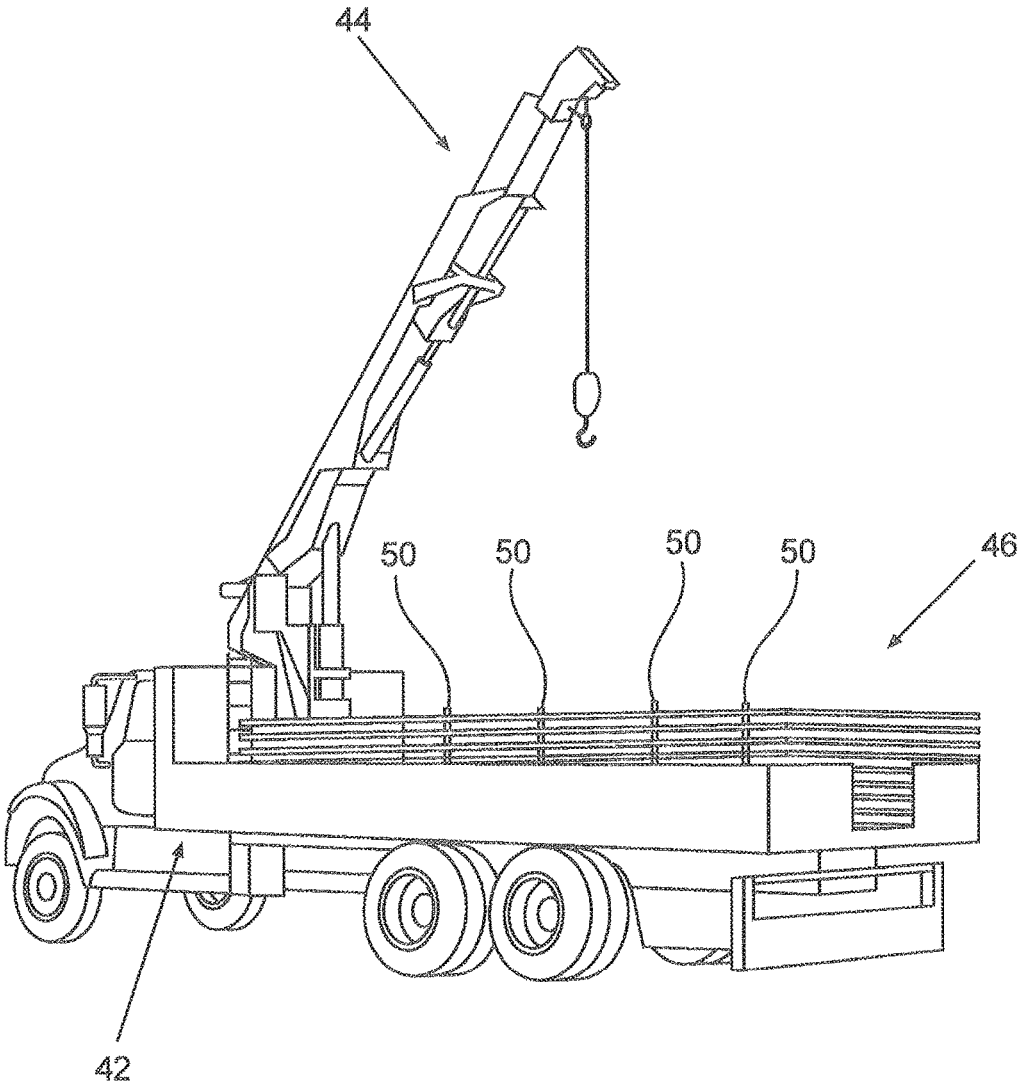
FIG. 5 is a perspective view of the protective panels according to an exemplary embodiment during transportation by a truck.

FIG. 5 shows the transportation of protective panels 46 on a truck 42, which, similar to the transportation of the structural elements 10, is preferably a truck 42 having its own crane 44 for uploading and unloading the protective panels 46 at their location at the erection site. Preferably, the protective panels 46 are uploaded on the truck 42 and placed horizontally, one on top of the other. The protective panels 46 are adapted to cover the four sides of the structural element as well as the roof. For protective panels 46 that are intended to be installed on the roof of the structural element, each of the protective panels 46 is provided preferably with four top lifting ears 50 for enabling lifting the protective panels 46 from the truck 42 by means of the crane 44 and installs them on the roof at the correct position. When the protective panels 46 are to be installed adjacent to walls 30 (FIGS. 1-3), then, each of the protective panels 46 is provided with two edge lifting ears 48 (shown in FIG. 7) for enabling lifting the protective panels 46 from the truck 42 by means of the crane 44 and install them at the correct position.

The erection site is chosen in an area that is accessible to the trucks that transport the structural elements as well as the protective panels. Furthermore, the erection site is prepared to be level, flat, and compacted, such that it can withstand the weight of all the structural elements 10 together with the protective panels 46 without showing any signs of local sinking.

Figure 6:
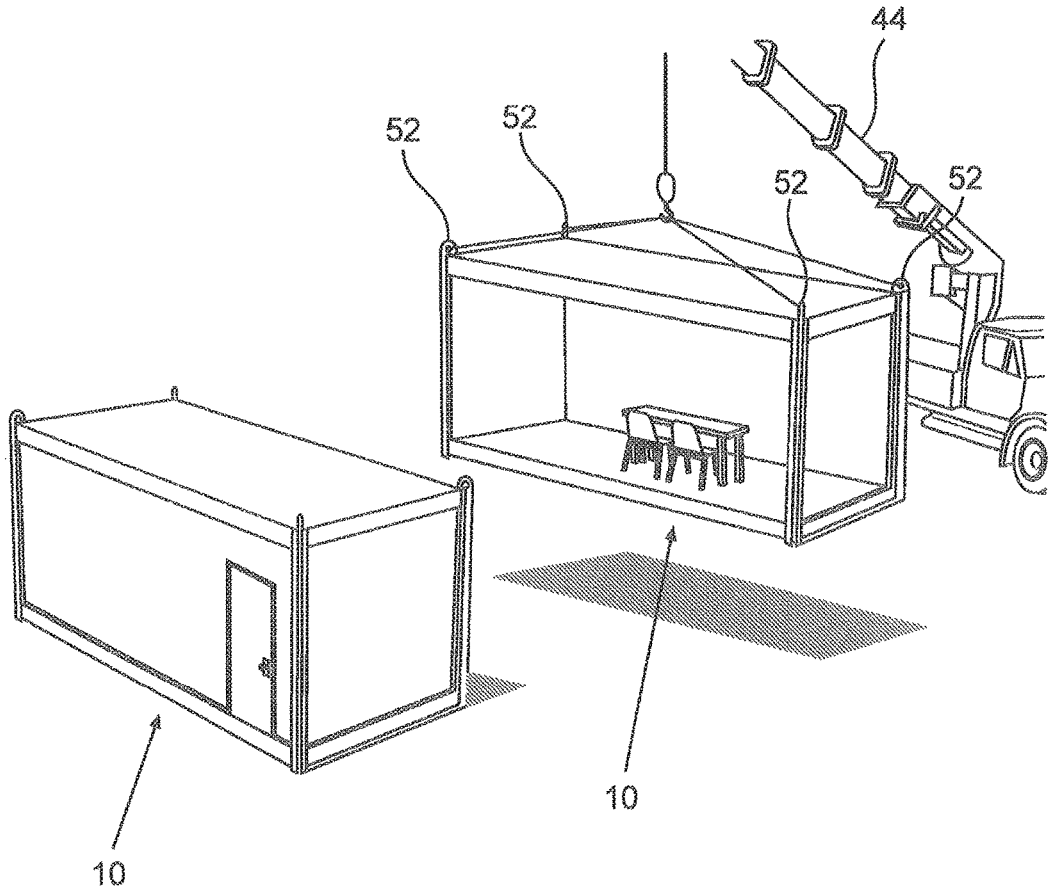
FIG. 6 is a perspective view of structural elements according to an exemplary embodiment during unloading at the erection site.

As shown in FIG. 6, when the truck 42 reached the unloading position at An erection site 40, each of the structural elements 10 is lifted through structure lifting ears 52, unloaded by means of the crane 44, and placed in a suitable positioning. When a first structural element 10 has been located in its final position, the next structural element 10 is placed adjacent to it, according to an erection plan, and in abutment therewith so that no gap is left inbetween and, if desired, the plurality of structural elements forming the multi layered protection system can be secured together by various methods known in the art. It should be mentioned that in case frames are being assembled at first, only the outer walls are installed onto the complete structure according to the erection plan.

At the next step, after all the structural elements 10 have been positioned in place and optionally secured together, the protective panels 46 are installed over the outer walls 30 of the structural elements 10 as shown in FIG. 7. Thus, the protective panel 46 is lifted by the crane 44 through the two edge lifting ears 48 and inserted from the upper side of the structural elements into the corresponding rails 36. In order to enable easier insertion of the protective panel 46 into the rails 36, the rails 36 are slightly converging downwardly. Thus, from a first aspect, an upper aperture 54 between the rails 36 is larger than a lower aperture 56 between the rails 36 by a distance that is typically between 5 mm to 50 mm. The upper aperture 54 is slightly larger than a length of the structural element, typically by 5 mm to 50 mm. From a second aspect, the lower aperture 56 between the rails 36 is similar to the structural element length and slightly larger therefrom.

By way of the above described construction of the rails 36, it is easier to insert a panel lower end 60 into the rails 36. Then, when the protective panel 46 is lowered to its final position, the panel lower end 60 rests firmly between the rails 36 at both sides thereof. As seen in FIG. 7, when it is desired to install a protective panel 46 over a wall 30 containing a door 34, the protective panel is provided with a corresponding door aperture 62 that mates in shape and position to the door 34 positioned at the wall 30.

Figure 8:
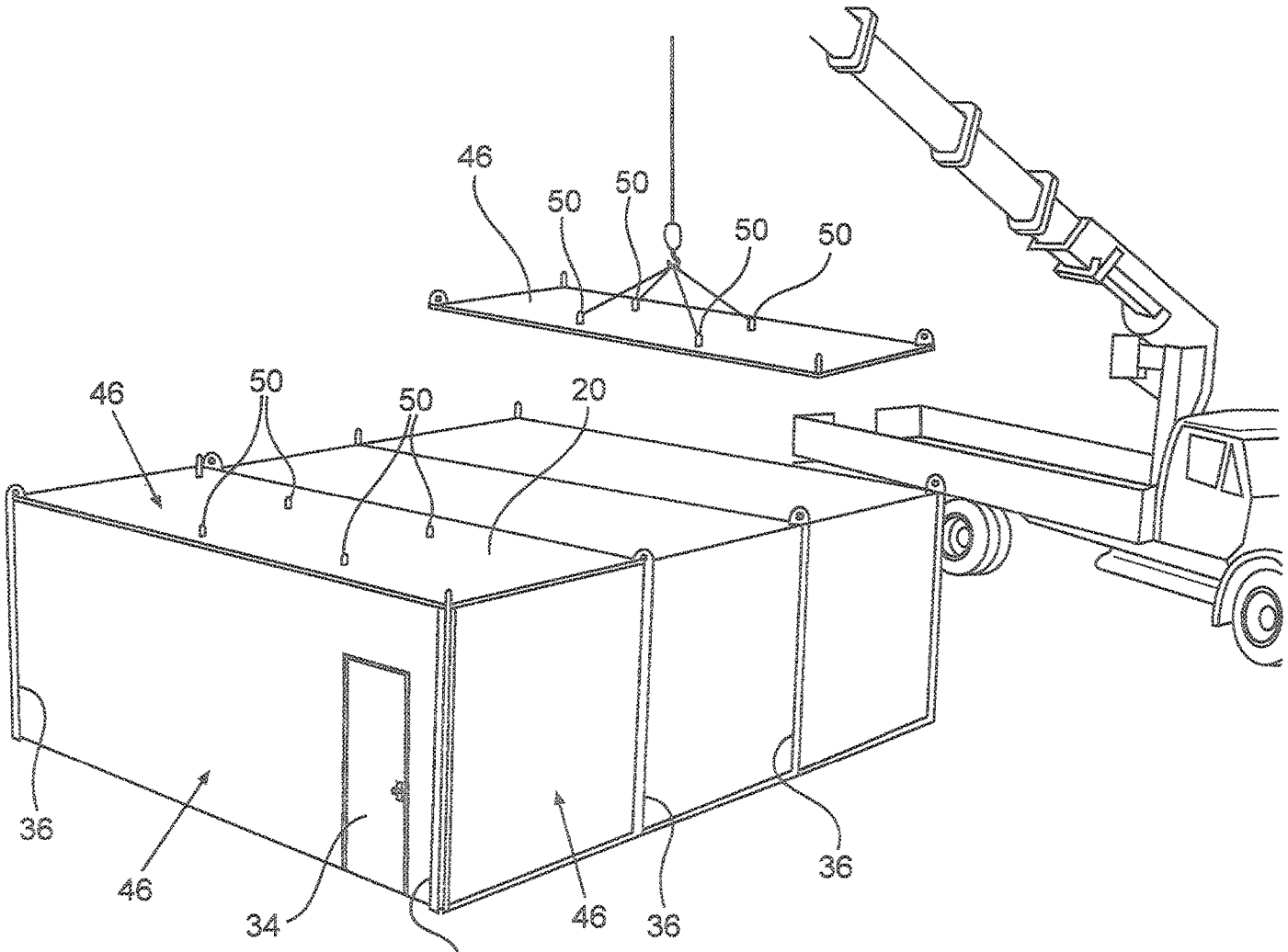
FIG. 8 is a perspective view of an assembling process of protective panels on the roof of structural elements according to an exemplary embodiment that are positioned in place.

At the next step, as shown in FIG. 8, the protective panels 46 are installed on the roof of the structural element. This is done by lifting each protective panel 46 through its top lifting ears 50 by means of the crane 44 and locating them at the right position. The protective panels 46 that are placed on the roof are preferably and slightly distanced from the roof, abutting the adjacent vertical protective panels 46 that are secured to the walls 30.

Figure 9:
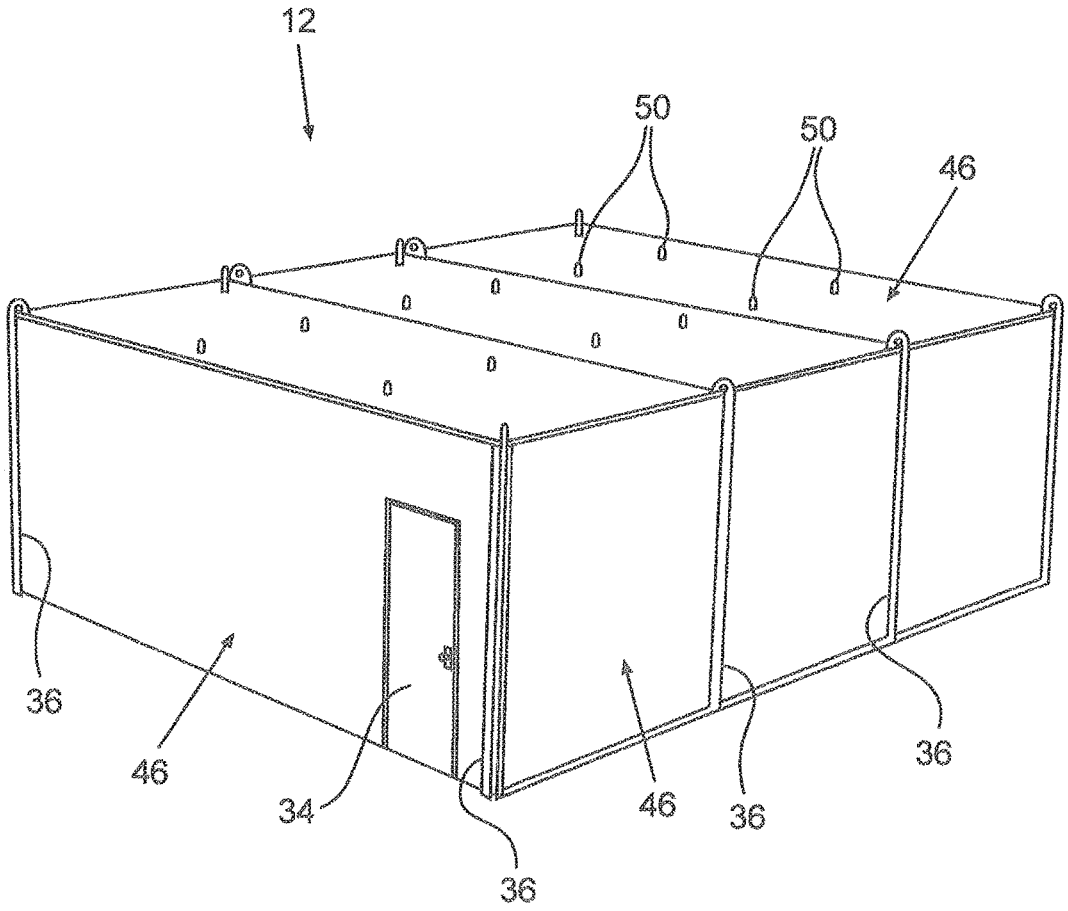
FIG. 9 is a perspective view of an assembled multi layered protection system according to an exemplary embodiment.

Thus, as shown in FIG. 9, when all the protective panels 46 have been installed on the outer walls of the structural elements 10 as well as the roof, a complete multi layered protection system 12 has been provided. The multi layered protection system 12 may serve various functions at a battle field, e.g., protective shelter for a forward command of the troops, protective shelter for operations department, protective shelter for a temporary forward medical station or a field hospital, and the like. Furthermore, the multi layered protection system 12 may be used for protection of expensive or sensitive equipment, such as telecommunication systems, computers, and the like.

Upon completion of the erection of the multi layered protection system 12, the structure is provided, preferably through a quick connection, with a ventilation system, chemical and biological filtration system, air conditioning, electrical power either by the mains or by a locally operated generator, communication systems, both common and secured, and any other additional systems that may be required. The multi layered protection system 12 can be completely erected in 4-5 hours from the moment the structural elements 10 and the protective panels 46 reached the erection site 40. Upon ending the need of use, the multi layered protection system 12 is disassembled in a reverse order and may be stored for future use. Thus, as explained above, the multi layered protection system 12 is modular, and it can be assembled and disassembled according to needs without affecting local infrastructures and agricultural areas.

Figure 10:
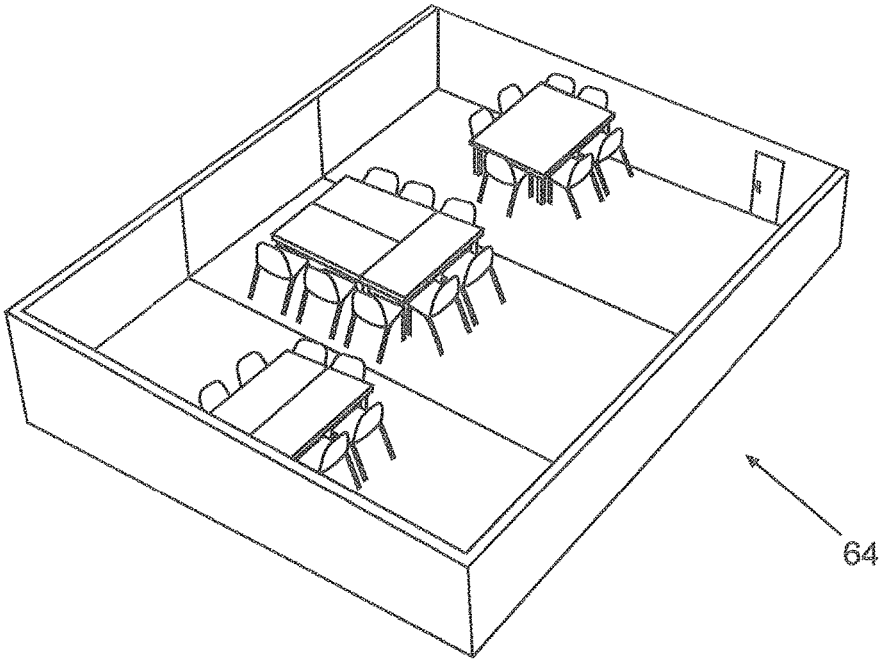
FIG. 10 is a perspective view of three structural elements according to an exemplary embodiment in a first assembling array, shown with the roof removed.

FIG. 10 shows a first assembling array 64. According to the first assembling array 64, three structural elements 10 in a size of a 20 ft ISO container are used, and are connected to each other by their long faces 26.

Figure 11:
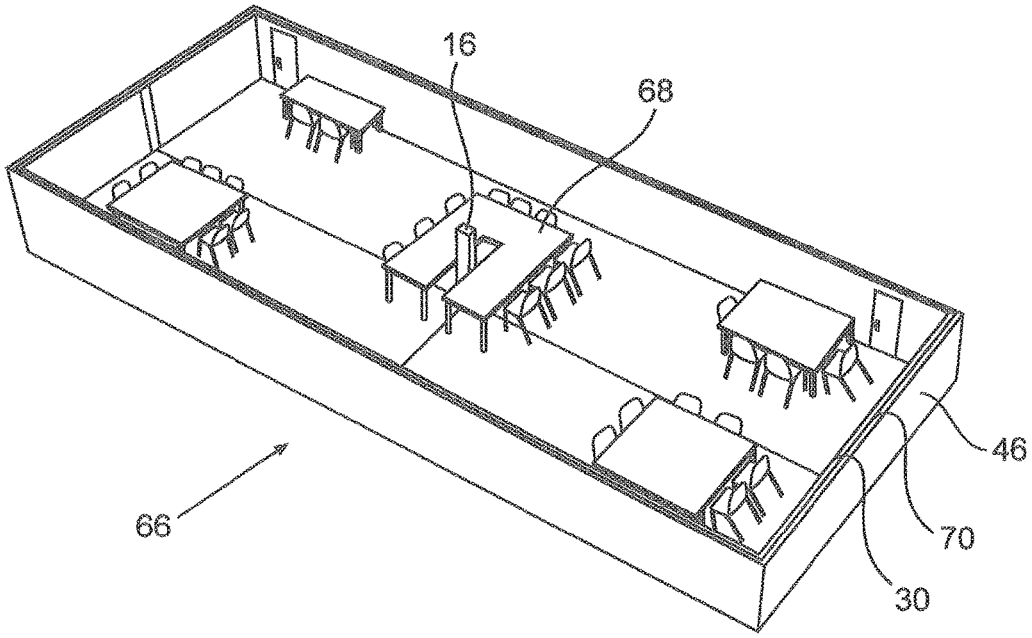
FIG. 11 is a perspective view of four structural elements according to the exemplary embodiment in a second assembling array, shown with the roof removed.

FIG. 11 shows a second assembling array 66 in accordance with another erection plan. According to the second assembling array 66, four structural elements 10 in a size of a 20 ft ISO container are used, and they are connected to each other by two long faces 26 and by two short faces 28. Since the beams 16 of the frame 14 of each of the structural elements 10 cannot be cut since they provide support to the roof and to the protective panels 46 that are positioned on the roof, there are cases wherein a central beam 17 is formed in the middle of the structure from four adjacent beams of each of structural element. In these cases, it may be required to re-design specific equipment such as a split table 68.

In the erection plan described above, the combination of the walls 30 and the roof (removed in the plan figures from clarity reasons) of the structural elements together with the protective panels 46 that are separated therefrom by means of a separation buffer 70, forms a multi layered protective system 66 that can withstand blasts of a 120 mm mortar shell, either direct hit thereof, or the shock wave created after the blast, without affecting the people that stay within the multi layered protective system. Since the structural elements are separated from the protective panels 46 using the buffer 70, they can be transported and lifted separately. This embodies a great advantage during the lifting action due to the reduced lifting weight and possibility to use a lighter crane and a lighter truck, factors that are critical during conflict times and emergency situations.

Figure 12A:
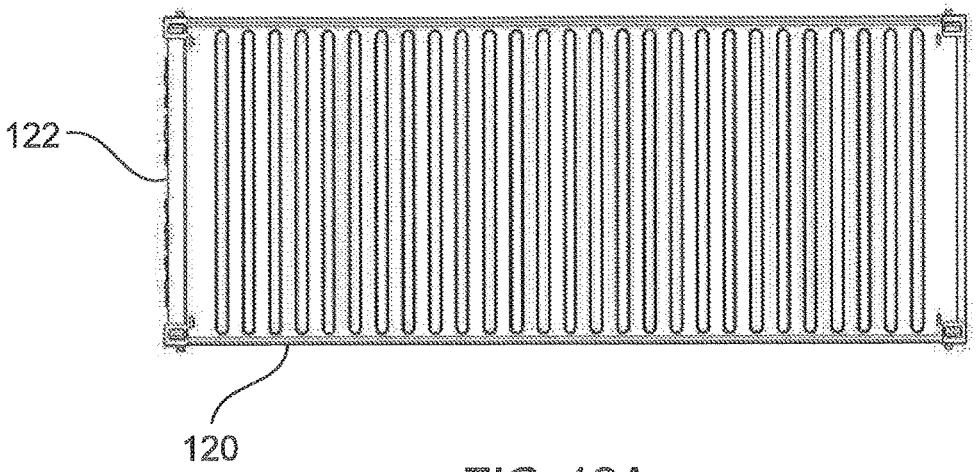
FIG. 12A is an upper view of an expandable structural element of a multilayered protection system according to an exemplary embodiment.
Figure 12B:
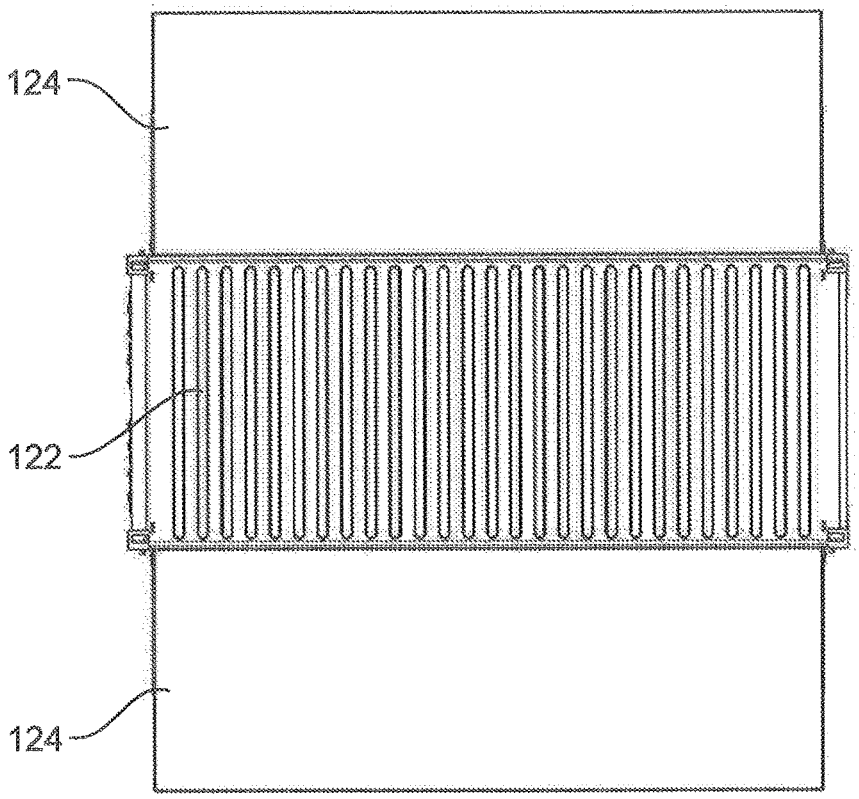
FIG. 12B is an upper view of the expandable structural element shown in FIG. 12A, in an expanded state.

In the same regard of reducing the time to erect the multilayer shelter system as well as reducing the amount of trucks that carry the structural elements, reference is now made to FIGS. 12A and 12B showing an upper view of an expandable structural element of a multi layered protection system according to an exemplary embodiment, in a folded state and expandable state. Container 120 having a frontal standard doorway 122 can be carried on a truck while when on site, two folded units 124, each from each elongated side of the expandable container 120 are expanded to form a shelter having a volume of about three containers. It should be mentioned that such expandable containers are known in the art. Units 124 can be unfolded after use. Upon having the full size structure, protective panels such as the ones shown herein before can be adjacently provided to the container walls. Several protective panels can be placed one on top of the other as well as buffers that can be placed in between the layers so as to form a multi layer protection system.

Optionally or alternatively, instead of placing full size protective panels as explained herein before that needs a crane to be placed adjacent to the walls of the multi layer protection system, according to another embodiment, smaller sized protective boards can be used.

Figure 13A:
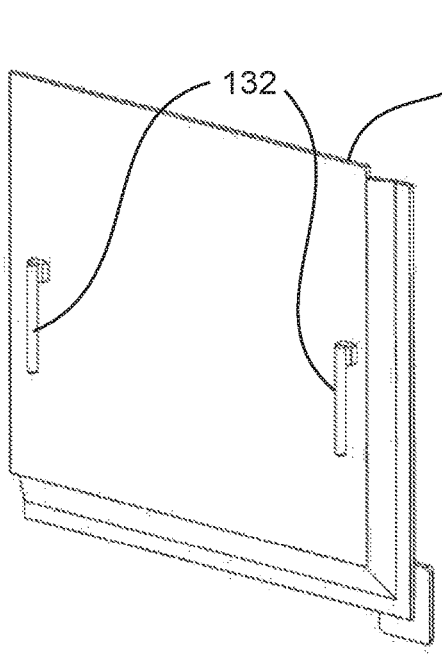
FIG. 13A is a protective panel that can be used in order to build a wall in accordance to an exemplary embodiment.
Figure 13B:
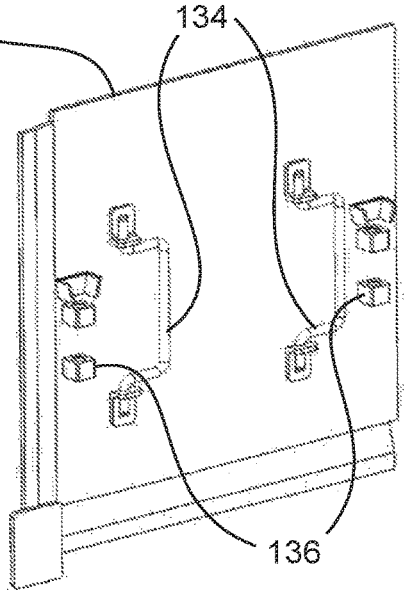
FIG. 13B is the protective panel shown in FIG. 13A from its outer side.

Reference is now made to FIGS. 13A and 13B illustrating a protective board that can be used in order to build a wall in accordance to an exemplary embodiment. The protective board can be made from the same materials as the protective panel and has similar protection characteristics. Protective board 130 has on the inner side, preferably two protruding pins 132 that are capable of being suspended onto corresponding rings that are provided onto the walls and frame of the structural unit or the container that was disclosed herein before. In this was, a wall shown in FIG. 14 can be built onto the structural elements so as to form a layer of protection onto the protection system.

It should be noted that the protective boards can be placed also on a dedicated construction that can be positioned adjacent to the wall that is being protected with multi layer protection. Those constructions are known in the art.

As can be seen in FIG. 13B, the outer side of the protective board is provided with handles 134 (preferably two) by which a user can suspend the boards onto the wall. The outer side of the protective board 130 is provided also with further rings 136 that are adapted to receive an additional suspended protective board that can form a plurality of boards.

Figure 14:
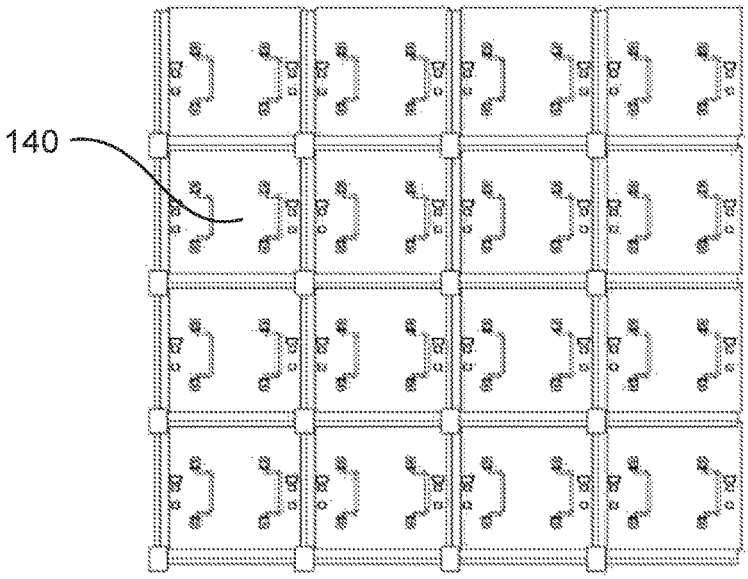
FIG. 14 is a protective wall formed on a multi layer protection system in accordance to an exemplary embodiment.

Thus, a protective wall 140 as shown in FIG. 14 can act as a layer placed on the protective system while placing a plurality of layers, one adjacent to the other will form a multi layer system. The advantage of using the protective boards is that the crane is becoming redundant.

Although the embodiments have been described to a certain degree of particularity, it should be understood that various alterations and modifications could be made without departing from the spirit or scope of the invention as hereinafter claimed.

For example, even though not specifically mentioned, the structural element containing a door is positioned such that the door is positioned away from the conflicting zone. The protective panel that covers a wall with a door does not have to be provided with an open door aperture. Alternatively, the door aperture may be covered by a door formed from a structure similar to the structure of the protective panel. In this case, it may be beneficial that the outer door, i.e., the door of the protective panel be opened outwardly, and, the door of the wall be opened inwardly.

If it is required to give protection to the armored vehicles of the troops within the multi layered protective system, the vehicles may be protected by additional protective panels in a form that meets the protection needs.

The invention claimed is:

1. A multi layered protection system comprising:

a plurality of box-shaped structural elements, each having a frame made of beams, wherein the frame is bounded by a floor at a lower side, a roof at an upper side, and four sides, and wherein at least two box-shaped structural elements of the plurality are positioned adjacent to one another so as to form a modular protection structure having outer sides;

a plurality of walls configured to bound said outer sides; and at least one layer of protective wall configured to be mounted adjacent to said plurality of walls and the roof, wherein said at least one layer of protective wall is a protective panel that covers the wall or the roof and wherein side beams of the beams are provided with oppositely directed vertical rails configured to receive the protective panel, and wherein the oppositely directed vertical rails converge in a downward direction.

2. The multi layered protection system according to claim 1, wherein said at least one layer of protective wall comprises a plurality of protective boards mounted adjacently to cover the wall.

3. The multi layered protection system according to claim 2, wherein the protective boards are made from a solid steel plate.

4. The multi layered protection system according to claim 1, wherein the structural elements are formed from a 20 ft ISO container.

5. The multi layered protection system according to claim 1, wherein the structural elements of the modular protection structure are secured to each other.

6. The multi layered protection system according to claim 1, wherein the protective wall is distanced from the wall adjacent to the protective wall by a separation buffer.

7. The multi layered protection system according to claim 1, wherein the multi layered protection system can withstand blasts of a 120 mm mortar shell.

8. The multi layered protection system according to claim 1, wherein the protective panel is formed from a solid steel plate.

9. The multi layered protection system according to claim 1, wherein the protective walls are formed from active protection layers.

10. The multi layered protection system according to claim 1, wherein the structural element can be an expandable structural element that can expand from both opposite sides.

11. The multi layered protection system according to claim 1, wherein said protective panel is provided with lifting ears configured to allow lifting the protective panel in a vertical or horizontal state.

12. The multi layered protection system according to claim 1, wherein one of the plurality of walls is provided with a door and wherein an adjacent protective wall has an opening that corresponds to the door.

13. A method of erecting a multi layered protection system in an erection site comprising:

delivering to the erection site a multi layered protection system comprising:

a plurality of box-shaped structural elements, each having a frame made of beams, wherein said frame is bounded by a floor at a lower side, a roof at an upper side, and four sides, and wherein at least two box-shaped structural elements of the plurality are positioned adjacent to one another so as to form a modular protection structure having outer sides;

a plurality of walls configured to bound said outer sides; and at least one layer of protective wall configured to be mounted adjacent to said plurality of walls and the roof, wherein said at least one layer of protective wall is a protective panel that covers the wall or the roof and wherein side beams of the beams are provided with oppositely directed vertical rails configured to receive the protective panel, and wherein a pair of vertical rails converge in a downward direction;

positioning the structural elements one by the other to form a protective structure having outer sides;

closing the outer sides with the walls; and adjacently positioning at least one layer of protective wall on the outer walls and the roof, wherein adjacently positioning the protective wall comprises inserting a protective panel through corresponding rails on the beams of the structural element so as to cover an entire wall.

14. The method of erecting a multi layered protection system in an erection site according to claim 13, wherein the structural element is an expandable element that is expanded to about three times the volume of the structural element.

* * * * *